United States Patent [19]

Post

[11] Patent Number: 4,494,284

[45] Date of Patent: Jan. 22, 1985

[54] ROLL

[75] Inventor: Helmut Post, Mettmann, Fed. Rep. of Germany

[73] Assignee: Schmolz & Bickenbach, Düsseldorf, Fed. Rep. of Germany

[21] Appl. No.: 266,617

[22] Filed: May 22, 1981

[30] Foreign Application Priority Data

May 24, 1980 [DE] Fed. Rep. of Germany ..... 3019921

[51] Int. Cl.[3] ..... B21B 27/02

[52] U.S. Cl. ..... 29/123

[58] Field of Search ..... 29/117, 123–125; 100/168, 176; 403/DIG. 7, 350

[56] References Cited

U.S. PATENT DOCUMENTS

| | | | |
|---|---|---|---|
| 2,367,831 | 1/1945 | Manson | 29/117 |
| 2,397,382 | 3/1946 | Smith | 403/350 |
| 2,965,217 | 12/1960 | Dommann et al. | 29/117 |
| 3,042,996 | 7/1962 | Nelson | 29/123 |
| 3,412,809 | 11/1968 | Shiret | 403/350 X |
| 4,229,950 | 10/1980 | Fessenden | 29/123 X |

FOREIGN PATENT DOCUMENTS

| | | |
|---|---|---|
| 425268 | 2/1926 | Fed. Rep. of Germany . |
| 175819 | 3/1922 | United Kingdom . |

*Primary Examiner*—Eugene F. Desmond

*Attorney, Agent, or Firm*—Toren, McGeady and Stanger

[57] ABSTRACT

A multi-part roll includes a hollow cylindrical axially extending roll body with a pair of ends spaced apart in the axial direction. A journal is connected to each of the ends of the roll body in a form-locking manner. The axes of the journals are in longitudinal alignment and define the axis of rotation of the roll. The axis of connection of the journals to the roll body, however, are disposed in spaced relation to the axis of rotation of the roll.

14 Claims, 12 Drawing Figures

Figure 1:
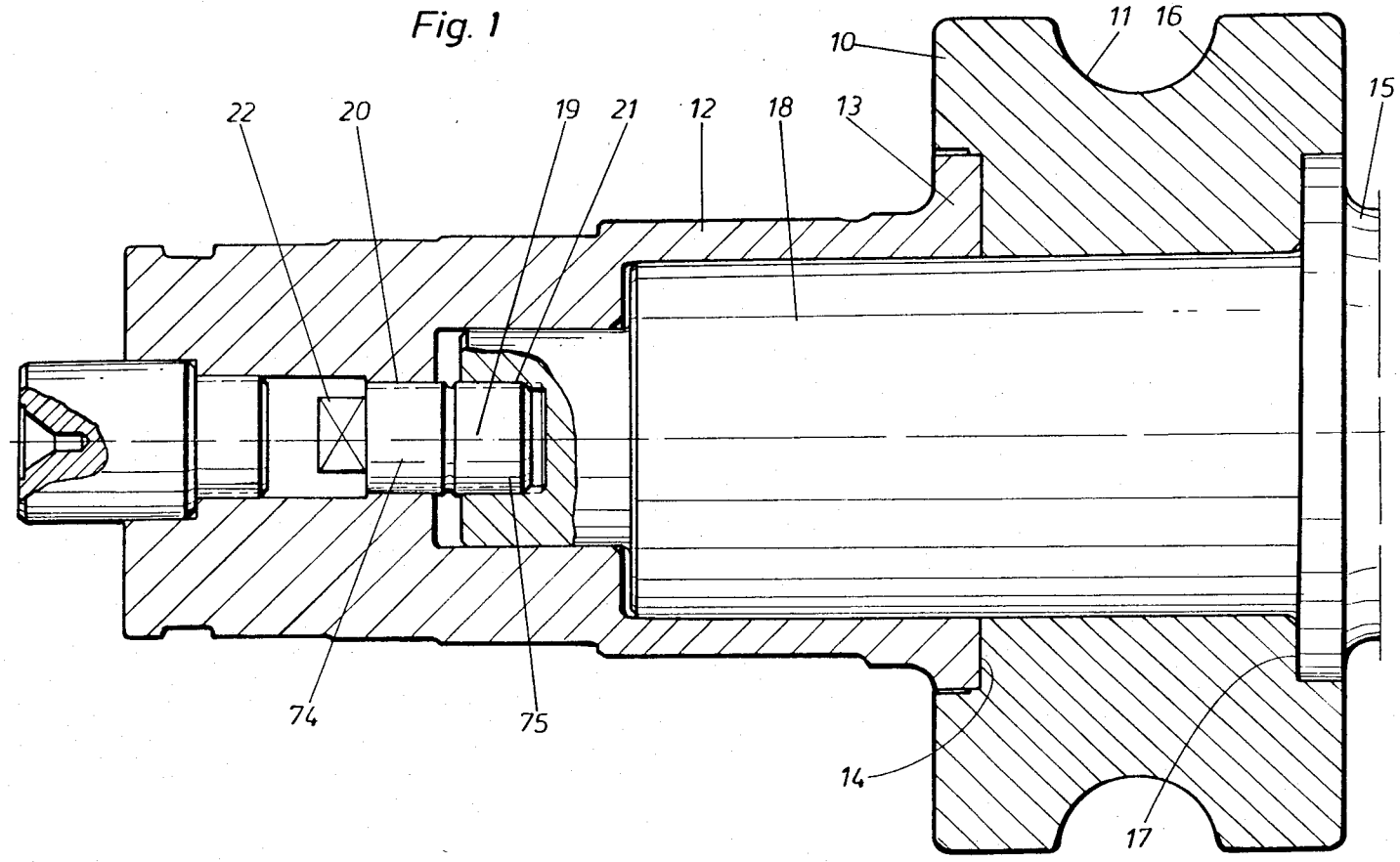

10
15
48
19
44
45
12
47
46
44

96
103
97
93
91
105
102
104
100
101

96
103
97
94
93
92
90
95
98
102
99
100
101
91

ROLL

The invention relates to a roll, the body of which is equipped at both ends with respectively one journal.

Such rolls are generally constructed symmetrically. The middle forms the body, which can be smooth or grooved. At both ends of the body there connect journals, with which the roll is mounted in its bearings. At the journals there are arranged to both sides wobblers, over which the rolls are driven. The roll body can also be asymmetrically grooved and formed as a pilger roll.

The known rolls are in a single piece. Since generally the body or grooved middle part wears off faster than the other roll parts, that is to say the journals and the drive journals, it is necessary to exchange the entire roll for a new one, as soon as the grooved middle part or the body is worn out; that means that the journals and the drive journals have to be exchanged too, even though a replacement of these parts, in and of themselves would not yet be necessary.

It is further known to fit roll bodies or roll shells on in one piece or to insert the journals on one side into the roll body. The connection can fundamentally be made by shrinking, welding, threading-in and the like. In the shrinking-on of roll bodies or roll shells onto one-piece axles, a shrink fit with an exact fit is necessary. When the roll bodies or roll shells are shrunken onto the axles, it is difficult to undo the shrinking connection again. Added to this, a shrinking connection can only be undone a limited number of times; moreover, not all desired material pairings are possible.

The prerequisite for connection roll bodies with axles by means of welding is the weldability of the materials to be connected. Added to that, the roll body practically can not be detached from the axle anymore and consequently the entire roll constitutes a no longer separable unit.

In making a connection of the roll body with the axle by means of threading-in, a separate securing against unintentional detachment of the parts from one another is necessary. In addition, the entire torque must be transmitted via the thread.

At the bottom of the invention there is the task of constructing a roll of the kind mentioned above in such a way that after wearing off of the most highly stressed part of the roll, only this part needs to be exchanged for a new one while the remaining parts of the roll can continue to be used.

This task is solved according to the invention thereby that the journals on the common turning axis are connected rigidly but detachably with one another and that the barrel is mounted between the journals so as to turn with them as a unit.

Thereby one arrives at a multiple-part embodiment of the roll which makes it possible, after wearing off of the worn out, grooved middle part or of the body, to replace only this roll part, but to use the corresponding two journals several times. This affords significant economical advantages for the practical use. The grooved middle part or the body and journal can be optimally constructed purposefully and variously according to the operation-dependent stress conditions, for example, taking into account wear, thermal shock, warm-welding and cold-welding, solidity, tenacity, surface refinement, saturation technique during casting, roll drafting, roll geometry, etc.

According to a further feature of the invention it is provided that the journals each have a flange with which they each form-lockingly engage in recesses provided at both ends of the barrel. In many cases it is sufficient when at least one flange which is eccentric to the common turning axis form-lockingly engages in a corresponding eccentric recess at one end of the barrel. This affords the possibility that the roll can be driven from the driving side via the eccentric flange and in turn drives the other journal via its eccentric flange along with the body at the same rotating speed.

For the sake of expediency, there is provided at one of the journals an axle extending through the barrel and connected with the other journal.

The resulting advantage consists particularly therein that the axle is connected in one piece with the journal and extends through the barrel. The connecting point between the two journals is situated outside of the body which makes assembly and disassembly of the roll easier and is advantageous for the use of the roll in operation. In addition, the axle is extended concentrically through the barrel in such a way that the material of the barrel is substantially uniformly distributed around the axle, which brings with it advantages in particular in the embodiment of such a roll as a pilger roll.

The axle can be mounted coaxially with the common turning axis. In this case the initiation of the torque in the barrel proceeds exclusively via the eccentric flanges. This arrangement is advantageous in a barrel which is constructed symmetrically to its turning axis.

In bodies in which such a symmetry around the turning axis is not afforded, as is, for example, the case in pilger rolls, the axle is advantageously mounted eccentrically to the common turning axis. By means of the eccentric extension of the axle in the asymmetrical cross-section through the groove, that is to say in the connecting axle which is centrally located in the center of the groove, as well as by means of the eccentric arrangement of the flanges on the journals, a simple initiation and transmission of the driving torque is afforded and the above-mentioned advantage regarding uniform distribution of the material of the grooved part around the axle is afforded. With an asymmetrical extension of the axle it is not absolutely necessary that the flanges be made eccentric, since by means of the asymmetrical extension of the axle alone a good initiation and transmission of the driving torque is guaranteed.

Advantageously, the two journals are rigidly but detachably connected with one another via the axle by means of a threaded bolt with a right-hand thread and left-hand thread. Such a thread bolt is provided on its one half with a right-hand thread and on its other half with a left-hand thread, in such a way that by the turn of the thread bolt in only one direction, for instance to the right, the elements to be connected to one another are drawn toward one another.

If the two journals are arranged coaxially to one another, it is recommended that the screw bolt also be arranged coaxially to the axle and the journals. With an eccentric extension of the axle it is possible to arrange the screw bolts either coaxially to the journal and eccentrically to the axle or else coaxially to the axle and eccentrically to the turning axis of the journals. By means of the thread bolt with right-hand thread and left-hand thread, the roll is held together force-lockingly. Moreover, because of this there is possible a simple assembly and disassembly of the roll.

In a further refinement of the invention it is provided that the thread bolt have separate right-hand thread and left-hand thread, to wit a right-hand thread at its one end and a left-hand thread at its other end.

The thread bolt can, however, also be constructed in such a way that it carries continuous, superimposed right-hand and left-hand threads, in such a way that there is superimposed onto a continuous right-hand thread a similarly continuous left-hand thread or vice-versa. In general it is sufficient if the right-hand thread and the left-hand thread have the same thread pitch. For certain cases of application it is, however, also possible to provide different thread pitches for the right-hand thread and the left-hand thread.

With the use of superimposed right-hand and left-hand threads it is advisable to offset the right-hand thread and left-hand thread by 180° in relation to one another in order to achieve hereby a uniform stress on the threads involved in the securing of the screw connection. Threads with large pitch angle are expedient since at the crossing of both thread lines every 180°, there is an interruption of the thread material.

At the end of the thread bolt accessible from the outside, there can be provided, in addition to the right-hand thread and left-hand thread for the securing and detaching of the roll parts, a further right-hand thread and left-hand thread. This additional right-hand thread and left-hand thread is expediently constructed as superimposed right-hand thread and left-hand thread.

Onto the additional right-hand thread and left-hand thread there can be screwed two nuts, of which one nut can be provided with a right-hand thread and the other nut with a left-hand thread, or vice-versa. Thereat, the corresponding nuts expediently are provided with the same thread pitch and thread depth as the threads of the thread bolt, but in right-hand and left-hand construction. Furthermore, the two nuts can be secured form-lockingly against one another against unitentional detachment by means of a tab washer.

In a further refinement of the invention, the journals can be provided at their ends adjacent to the body with respectively one tang, the body being mounted on said tangs by means of adjusting springs. On the other hand, the tangs can be arranged eccentrically to the common axis of rotation and can engage in corresponding eccentric recesses at the ends of the body. At the journals there can be arranged respectively one eccentric which engages form-locking in corresponding sideward recesses in the ends of the body. The tangs can be made smaller in diameter than the journals. Their length is measured out in such a way that in the assembled condition they have a certain distance from one another. It is also possible to prolong a drive journal beyond the middle of the roll so that the upper drive journal can be made correspondingly shorter or else be omitted entirely.

For some cases of application it is purposeful to mount the body on the journals by means of a clamping bush.

Furthermore, the body can be constructed in such a way that, for instance, a journal has a conical end on which the body is mounted with a corresponding conical bore and, for instance, by means of adjusting springs, while the other end of the journal can be constructed differently.

For certain cases of application it is advantageous that both journals have conical ends and the body be mounted with a corresponding double-conical bore on the two conical ends of the journals by means of adjusting springs. Hereat, too, the journals which are situated opposite to one another are held together by means of a thread bolt with right-hand thread and left-hand thread.

The roll body can be cylindrical or else grooved. It is possible, in particular, to groove the roller in the manner of a pilger roll.

According to a further feature of the invention it is provided that drive journals and journals be connected rigidly but detachably with one another on the common axis of rotation with a thread bolt with left-hand thread and right-hand thread.

There can thereat be provided centrically in the journals respectively one axial threaded bore with right-hand thread and in the drive journals, centrically as well, respectively one axial threaded bolt with left-hand thread, or vice versa, into which bore the thread bolt can be screwed in with its left-hand thread and right-hand thread.

The drive journals can have conical ends and the journals can be mounted with corresponding conical bores on the conical ends of the drive journals by means of adjusting springs. On the other hand it is also possible that the drive journals have cylindrical ends and the journals be mounted with a corresponding cylindrical bore on the ends of the drive journals by means of adjusting springs.

The detachable connection of the drive journals with the journals by means of the thread bolt affords the possibility to make functional again without problems a roll in which for instance a drive journal has been torn off. That can be significant especially then when the roll cannot be repaired by welding or shrinking. This is significant furthermore when the drive journal is in a reversing operation and thereby is submitted to increased wear in the wobbler grooves.

Figure 2:
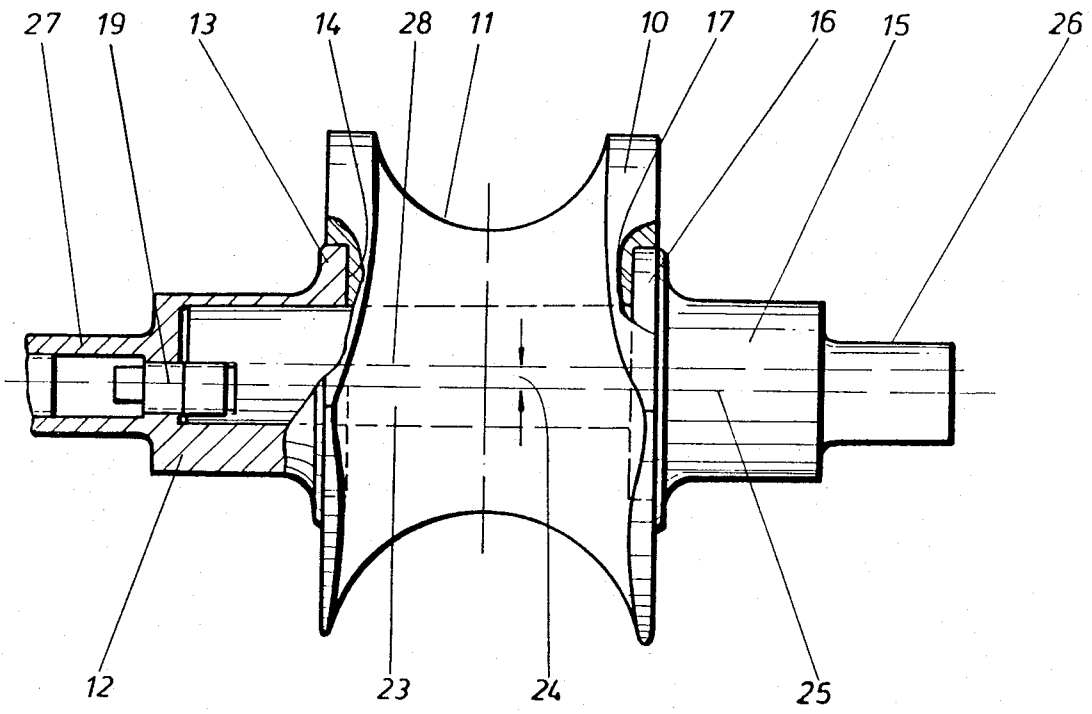
Figure 3:
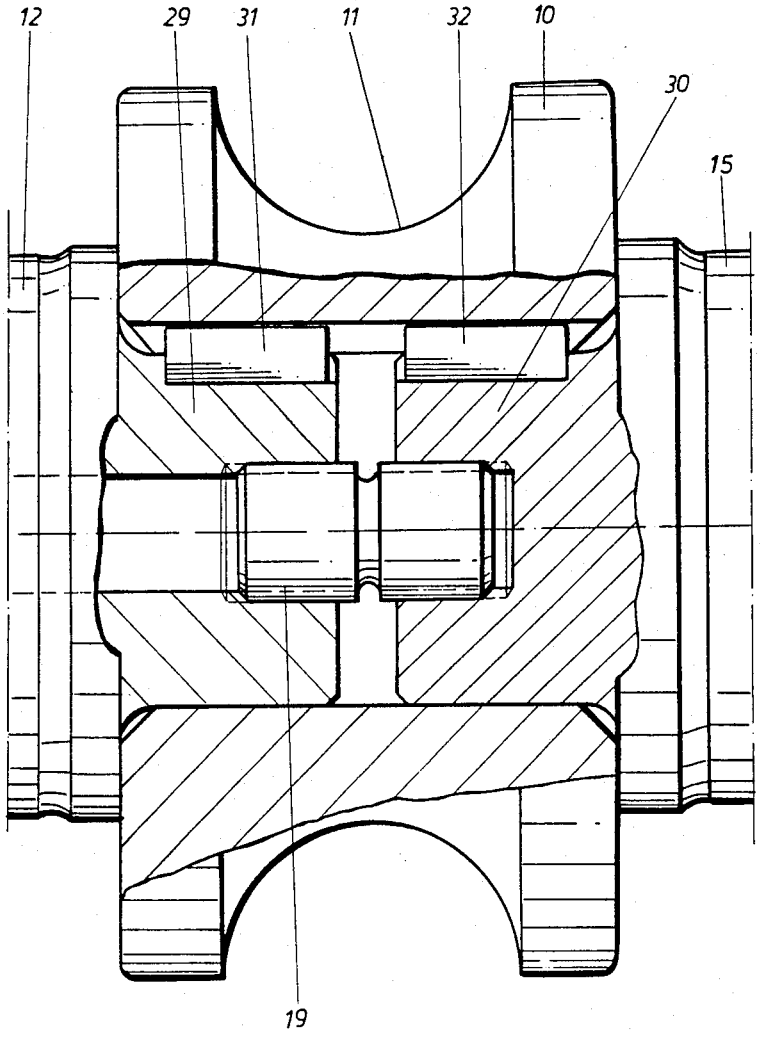
Figure 4:
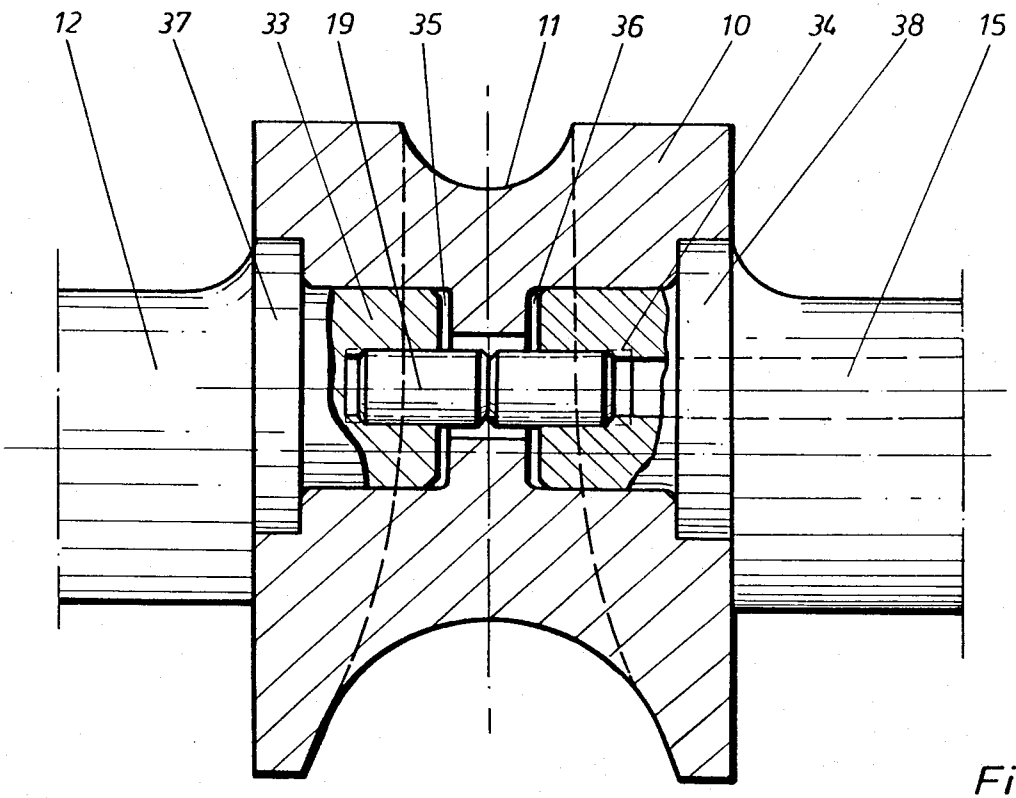
Figure 5:
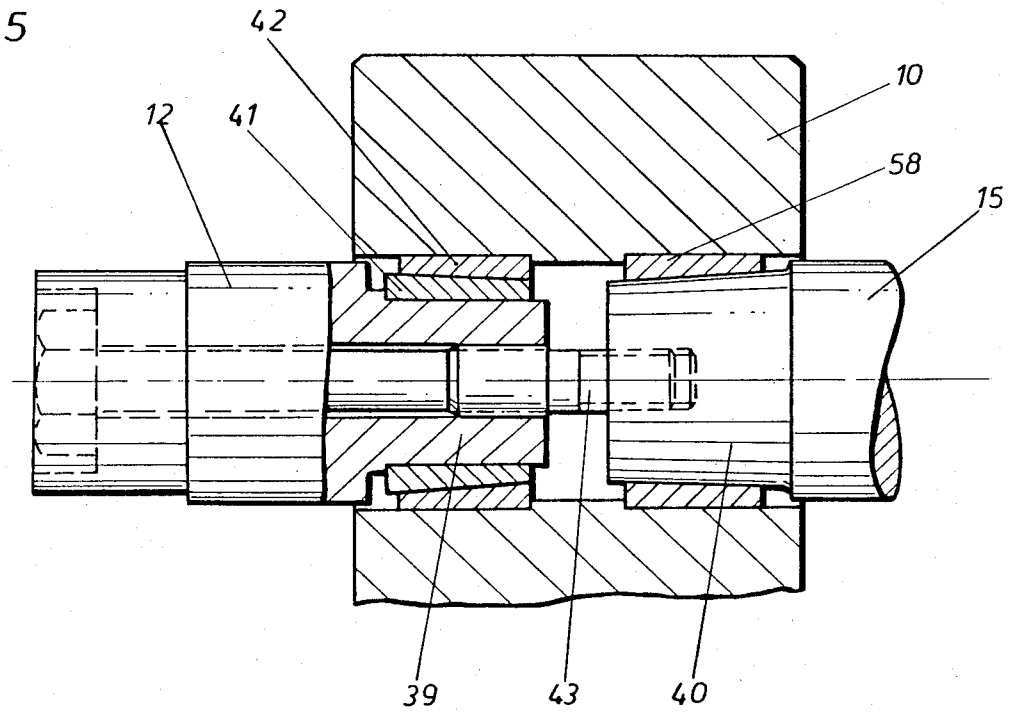
Figure 6:
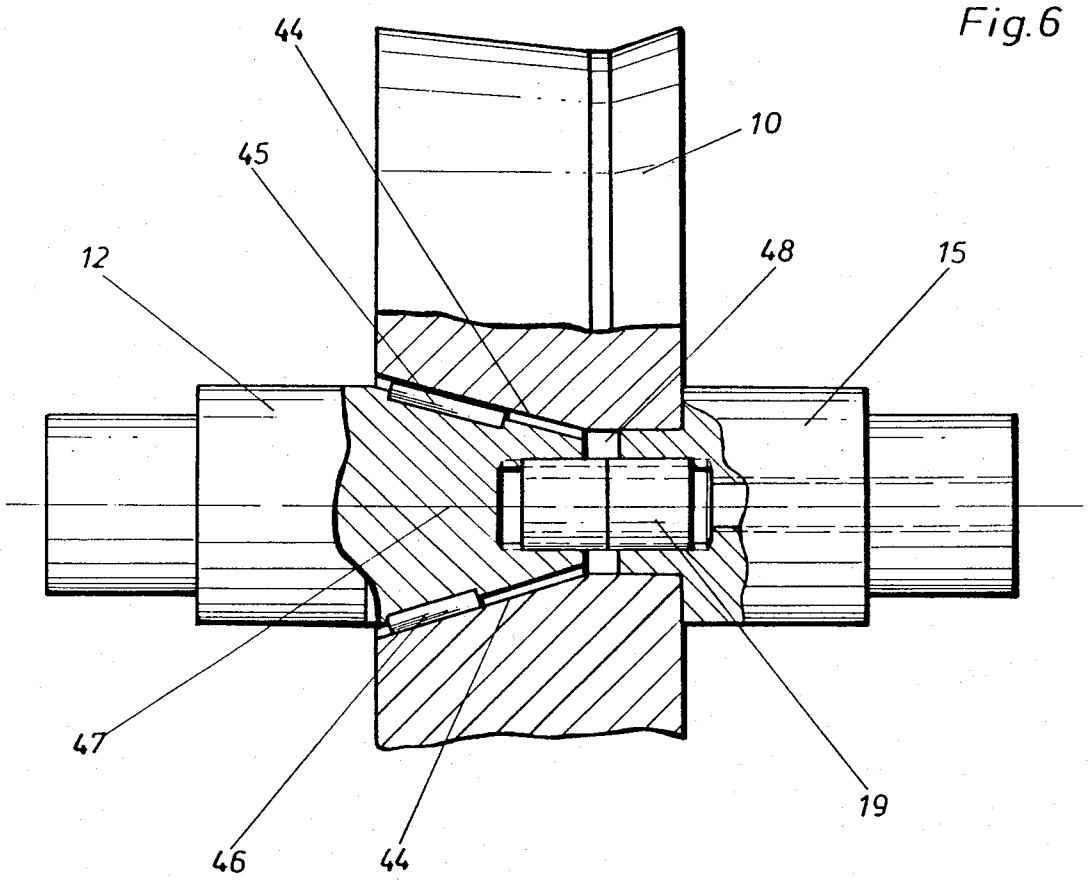
Figure 7:
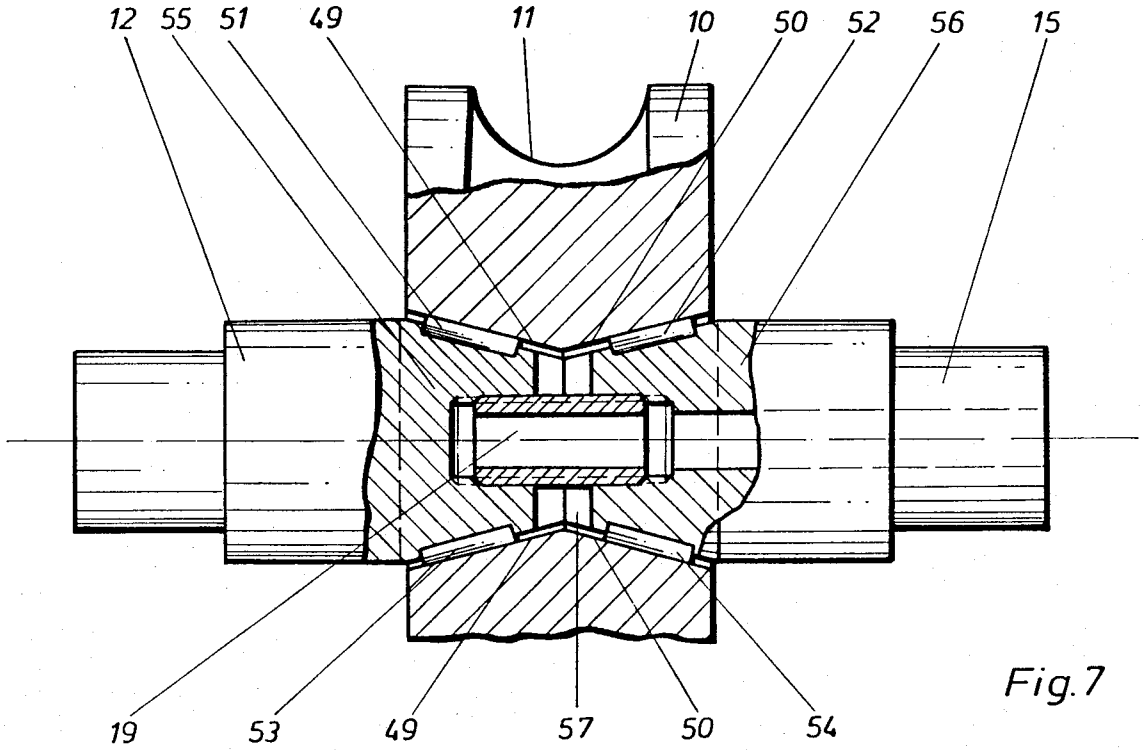
Figure 8:
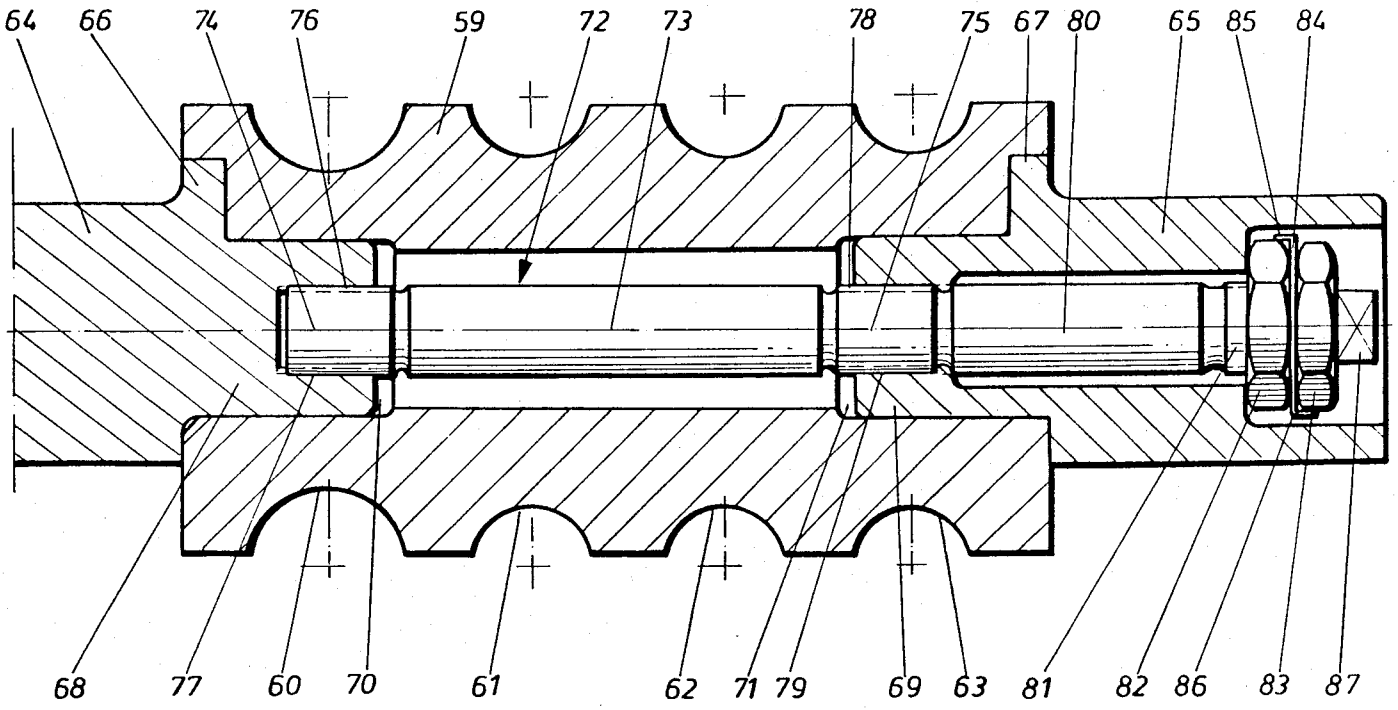
Figure 9:
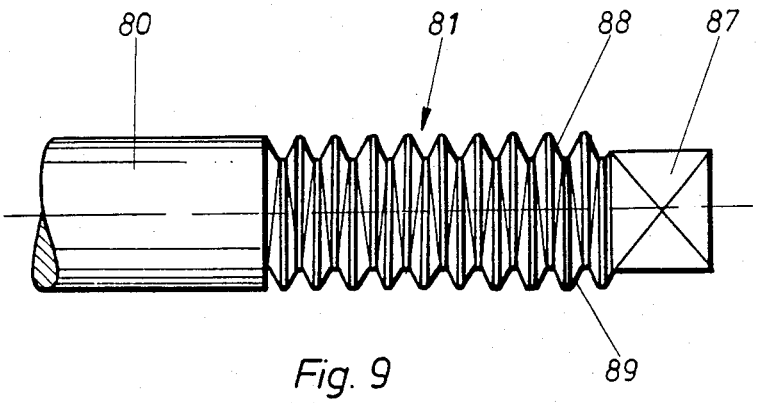
Figure 10:
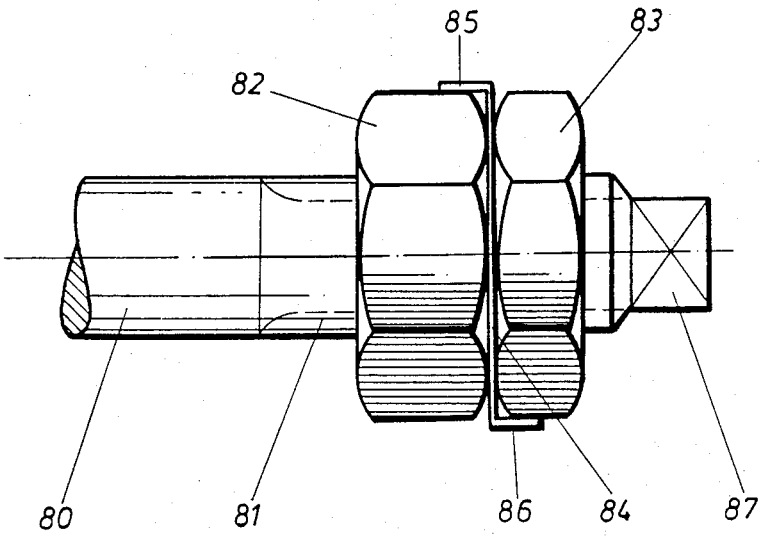
Figures 11, 12:
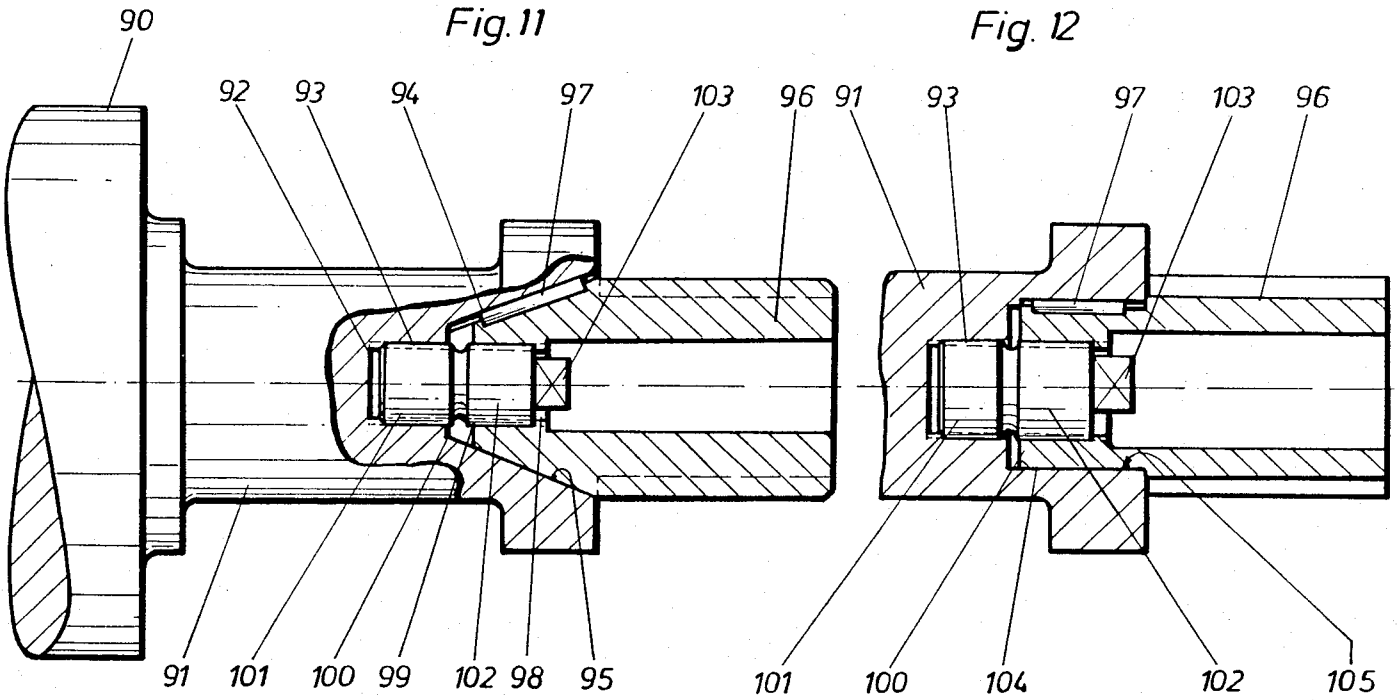

The invention is elucidated in detail below with the help of several embodiments represented in the drawings. There is shown, respectively in cross-section, in:

FIG. 1, a roll according to a first embodiment;

FIG. 2, a roll according to a second embodiment;

FIG. 3, a roll according to a third embodiment;

FIG. 4, a variation of the roll represented in FIG. 3;

FIG. 5, a further variation of the roll represented in FIG. 3;

FIG. 6, a roll according to a fourth embodiment;

FIG. 7, a variation of the roll represented in FIG. 6;

FIG. 8, a roll according to a fifth embodiment;

FIG. 9, the additional right-hand thread and left-hand thread of the thread bolt;

FIG. 10, a representation according to FIG. 9 with screwed-on nuts;

FIG. 11, a roll according to a sixth embodiment; and

FIG. 12, a variation of the roll represented in FIG. 11.

The roll represented in FIG. 1 and constructed in several parts according to the invention has a roll body 10, with a grooved middle part forming a circumferential pass groove 11. The journal 12 on the left side in the drawing engages with an eccentric 13 into a correspondingly eccentrically constructed recess 14 of the body 10. Accordingly, the journal 15 on the right side in the drawing has an eccentric flange 16 which engages form-lockingly into a corresponding eccentric recess 17 of the body 10. An axle 18 of the drive journal 15 extends coaxially to the two journals 12 and 15 as well as to the body 10 through the body 10 and is connected via a thread bolt 19 with right-hand thread 20 and left-hand thread 21 with the journal 12. The turning in and out of the thread bolt 19 takes place front-sidedly via a square end portion 22.

The roll represented in FIG. 2 is constructed with its body 10 as a pilger roll with a corresponding groove 11. The body 10 has on both sides eccentric recesses 14 and 17 into which there engage, form-lockingly, corresponding eccentric flanges 13 and 16. The axle 23 is extended eccentrically to the axle 25 of the journal 15 by the measurement 24. 26 and 27 designate the two drive journals. The thread bolt 19, in the present embodiment, is arranged concentrically to the journals 12 and 15 and eccentrically, by the measurement 24, to the center line 28 of the axle 23.

Because of the eccentric mounting of the axle 23 in relation to the common axis of rotation, the axle 23 extends concentrically through the center of the grooved part. This means that the material of the body 10 is distributed uniformly throughout around the axle 23. Because of this, the body 10 and the axle 23 extend coaxially to one another, which is especially advantageous for the special stress conditions in a pilger roll. On the other hand this also means that the torque is no longer transmitted into the body 10 over the axle 23. The axle 23 consequently does not have to be designed for this stress anymore, since the torque is transmitted into the body 10 exclusively over the flanges 13 and 16.

In variation from the representation according to FIG. 2, it is also possible to mount the thread bolt 19 concentrically to the axle 23. This means that the thread bolt is mounted eccentrically to the common axis of rotation in this case.

In the embodiment represented in FIG. 3 there are arranged concentrically to the journals 12 and 15 tangs 29 and 30 on which there is mounted the body, over adjusting springs 31 and 32, in such a manner as to turn as a unit with the tangs. The two tangs 29 and 30 are connected to one another via the thread bolt 19 with a right-hand thread and left-hand thread and are made smaller in diameter than the journals 12 and 15. Moreover, the length of the tangs 29 and 30 is measured out in such a way that between the end surfaces of the two tangs 29 and 30 there remains a space.

In the embodiment represented in FIG. 4, the tangs 33 and 34 are arranged eccentrically to the journals 12 and 15 and engage form-lockingly into corresponding sideward recesses 35 and 36. There are provided, additionally, eccentrics 37 and 38 which also engage form-lockingly into the recesses assigned to them at the two sides of the body. The roll shown here is a pilger roll.

In the roll represented in FIG. 5, there are arranged at the journals 12 and 15 journals 39 and 40 with a somewhat smaller diameter. The body 10 is mounted on the left side on the journal 39 in such a manner as not to be able to turn in relation to it, by means of the clamping bush consisting of the two rings 41 and 42, while the conical journal 40 is mounted over the conical bush 58. The two journals 12 and 15 are connected to one another via a screw 43.

The body 10 according to FIG. 6 has a conical bore 44 with which it is mounted over adjusting springs 45 and 46 on a conical end 47 of the journal 12. On the opposite side, the body bearing is constructed cylindrically. The two journals 12 and 15 situated opposite each other are also connected with one another via the thread bolt 19. For the purpose of a secure connection of the two journals 12 and 15, these journals maintain a certain distance 48 in the assembled condition.

The body 10 according to FIG. 7 is provided with a double-conical bore 49,50 with which it is mounted over several adjusting springs 51,52,53 and 54 on the two conical ends 55 and 56 of the journals 12 and 15. The two journals 12 and 15 are also connected via the thread bolt 19 with right-hand thread and left-hand thread in such a way that between the two front surfaces of the conical ends 55 and 56 of the journals 12 and 15 there remains a space 57.

In FIG. 8 there is represented a roll, the body 59 of which has four passes 60,61,62 and 63. The journals 64 and 65 are mounted with their eccentric flanges 66 and 67 is accordingly constructed recesses of the body 59 and engage with threaded journals 68 and 69 of smaller diameter into corresponding lathed out recesses 70 and 71 of the body 59.

A thread bolt 72 has, to both sides of a middle part 73, ends 74 and 75 with threads. The end 74 has a right-hand outer thread 76 which is screwed into the similarly right-hand inner thread 77 of the threaded journal 68. Similarly, the end 75 has a left-hand outer thread 78 with which it is screwed into the similarly left-hand inner thread 79 of the threaded journal 69.

The thread bolt 72 is extended beyond the end 75 by a bolt part 80. At the right end of the bolt part 80 there is provided a right-hand and left-hand thread 81 which can be constructed as separate right-hand and left-hand thread, or else also as superimposed right-hand and left-hand thread. Onto the thread 81 there are screwed two nuts 82 and 83, whereat the inner nut 82 has a right-hand thread and the outer nut 83 has a left-hand thread, or vice-versa. Between the two nuts 82 and 83 there is provided a tab washer 84 in order to prevent a spontaneous detachment of the nut 83. The tab washer 84 has at both ends respectively one bent portion 85 and 86 which are produced by bending, whereat the bent portion 5 grips over the nut 82 and the bent portion 86 grips over the nut 83. This assures that a displacement of the nuts 82 and 83 out of the position on the thread bolt 72 is ruled out once this position has been established. A strong stressing of both nuts 82 and 83 against one another by means of frictional connection is not necessary, so that the connection can always be detached easily, and above all, without damage. At the end of the thread bolt 72 there is provided a square end portion 87 via which the thread bolt 72 can be turned and thus the roll parts can be secured together or be detached from one another.

FIG. 9 shows the bolt part 80 of the thread bolt 72 with the overlapping right-hand thread and left-hand thread 81 whereat the two nuts 82 and 83 as well as the tab washer are left out. 88 designates the right-hand thread and 89 designates the left-hand thread.

FIG. 10 shows the bolt part 80 with the nuts 82 and 83 screwed on and, located therebetween, the tab washer 84 with the bent portions 85 and 86.

According to FIG. 11, there is embedded, in one piece, a body 90 with a journal 91. In the journal 91 there is arranged, centrically, a thread bore 92 with a right-hand inner thread 93. Towards the outside, the bore 92 continues in a conical bore 94 with which the journal 91 is mounted on the conical end 95 of a drive journal 96 by means of an adjusting spring 97. In the drive journal 96 there is provided, also centrically, an axial threaded bore 98 with left-hand inner thread 99. The thread bolt 100 is screwed into the two threaded bores 92 and 98. This thread bolt has at its one end 101 a right-hand outer thread and at its other end 102 a left-hand outer thread, so that by the turning of the thread bolt 100 by means of the cylindrical portion 103, the journal 91 and the drive journal 96 can be secured to one another or be detached from one another.

The embodiment according to FIG. 12 distinguishes itself from the embodiment represented in FIG. 11 substantially only thereby that the drive journal 96 has a cylindrical end 104 on which there is mounted the journal 91 with a corresponding cylindrical bore 105 by means of an adjustment spring 97.

The embodiments represented in FIGS. 11 and 12 afford the possibility to make functional again a roll, the drive journal 96 of which has torn off, simply and with comparatively minor expense thereby that the torn-off drive journal 96 is replaced by a new one.

I claim:

1. A multi-part roll comprising a hollow cylindrical axially extending roll body with a pair of ends spaced apart in the axial direction, one journal connected in a form-locking manner into one of the ends of said roll body, another journal connected in a form-locking manner into the other end of said roll body, said journals having aligned longitudinal axes defining the axis of rotation of said roll and the axis of the connection of said journals and said roll body disposed in spaced relation to the axis of rotation of said roll, at least one of said journals having an axially extending extension thereon projecting at least partially into said roll body for connecting said journals together, said extension on said journal extends through said roll body forming a support axis and is attached at its free end to the other said journal, a thread bolt rigidly and detachably connects said two journals to one another via said extension, and said thread bolt having a right-hand thread and left-hand thread.

2. A multi-part roll according to claim 1, characterized in that said thread bolt is arranged coaxially to said extension and said journals.

3. A multi-part roll according to claim 1, characterized in that said thread bolt is arranged coaxially to said journals and eccentrically to said extension.

4. A multi-roll according to claim 1, characterized in that said thread bolt is arranged coaxially to said extension and eccentrically to said journals.

5. A multi-part roll according to claim 1, characterized in that said thread bolt has separate right-hand and left-hand threads, to wit, at its one end exclusively said right-hand thread and at its other end exclusively said left-hand thread.

6. A multi-part roll according to claim 1, characterized in that said thread bolt has a continuous right-hand thread and left-hand thread superimposed on one another.

7. A multi-part roll according to claim 6, characterized in said right-hand thread and said left-hand thread have the same thread pitch.

8. A multi-part roll according to claim 6, characterized in that said right-hand thread and said left hand thread have different thread pitches.

9. A multi-part roll according to claim 6, characterized in that when said right-hand thread and left-hand thread are superimposed on one another, they are offset by 180° in relation to one another.

10. A multi-part roll according to claim 6, characterized in that one end of said thread bolt is accessible from the outside of said roll, and there is provided, in addition to said right-hand thread and left-hand thread, a further right-hand thread and left-hand thread for the tightening and detaching of the roll parts.

11. A multi-part roll according to claim 10, characterized in that said further right-hand thread and left-hand thread is constructed as superimposed right-hand thread and left-hand thread.

12. A multi-part roll according to claim 10 or 11, characterized in that two nuts are screwed onto said further right-hand thread and left-hand thread of which one said nut is provided with right-hand thread and the other said nut is provided with left-hand thread.

13. A multi-part roll according to claim 12, characterized in that a tab washer secures said two nuts form-lockingly against one another against unintended detachment.

14. A multi-part roll comprising a hollow cylindrical, axially extending roll body with a pair of ends spaced apart in the axial direction, one journal connected in a form-locking manner into one of the ends of said roll body, another journal connected in a form-locking manner into the other end of said roll body, said journals having aligned longitudinal axes defining the axis of rotation of said roll and the axis of the connection of said journals and said roll body disposed in spaced relation to the axis of rotation of said roll, a thread bolt rigidly and detachably connects the one journal and the another journal to one another on the axis of rotation, and said thread bolt has left-hand thread and right-hand thread, there is provided centrically in said another journal, one axial thread bore with a right-hand thread and in said one journal, also centrically, one axial thread bore with a left-hand thread, into which bores said thread bolt is screwed with its left-hand thread and right-hand thread.

* * * * *